United States Patent [19]

Müller et al.

[11] 4,426,158

[45] Jan. 17, 1984

[54] ANALOG-DISPLAY ELECTRONIC WATCH WITH STATOR MOUNTED ROTOR, HAND SPINDLES AND GEAR TRAIN

[75] Inventors: Jacques Müller, Reconvilier; Elmar Mock, Bienne, both of Switzerland

[73] Assignee: ETA S.A., Fabriques d'Ebauches, Granges, Switzerland

[21] Appl. No.: 350,136

[22] Filed: Feb. 19, 1982

[30] Foreign Application Priority Data

Feb. 26, 1981 [CH] Switzerland ..... 1280/81
Mar. 6, 1981 [CH] Switzerland ..... 1505/81

[51] Int. Cl.[3] ..... G04B 19/00

[52] U.S. Cl. ..... 368/76; 368/157; 368/160; 310/40 MM

[58] Field of Search ..... 368/76, 80, 88, 155, 368/157, 160, 220, 319, 320, 321, 72, 73, 74, 250, 251, 249, 259, 260, 69, 70; 310/40 MM

[56] References Cited

U.S. PATENT DOCUMENTS 3,564,314 2/1971 Haydon ..... 310/172
3,892,068 7/1975 Erard ..... 368/190
4,006,374 1/1977 Nakagawa ..... 310/40 MM
4,079,582 3/1978 Tamaru et al. ..... 58/23 D
4,086,753 5/1978 Tsuchiya et al. ..... 310/40 MM
4,232,512 11/1980 Yoshikawa et al. ..... 368/82
4,297,838 11/1981 Watanabe et al. ..... 310/40 MM
4,392,930 8/1982 Pellaton ..... 310/40 MM

FOREIGN PATENT DOCUMENTS 1226928 8/1960 France .
2312054 12/1976 France .

*Primary Examiner*—Bernard Roskoski
*Attorney, Agent, or Firm*—Spensley, Horn, Jubas & Lubitz

[57] ABSTRACT

The watch casing 102 is made of plastics material. The stator 2 of the motor serves at the same time as the support for the rotor 32 and as a plate for the spindles 18, 22, 24 for the hands and the gear train 48, 46, 47, 20. The printed circuit 304 is secured to the bottom 104 of the casing by heat-sealing. The cell is housed in a chamber 262 disposed in a thick portion of the bottom of the casing.

9 Claims, 8 Drawing Figures

ANALOG-DISPLAY ELECTRONIC WATCH WITH STATOR MOUNTED ROTOR, HAND SPINDLES AND GEAR TRAIN

BACKGROUND OF THE INVENTION

The present invention relates to an analog-display electronic watch and is concerned with the problem of assembling the components of the watch in the casing thereof, the components essentially comprising a motor, spindles for the hands, gears coupling the motor to the spindles, a cell for supplying power to the motor, and a printed circuit carrying circuits for controlling the motor, including a quartz crystal resonator. For simplicity the term "spindles" is used to embrace both arbors and pipes.

Conventional analog-display electronic watches have a movement which is housed in a casing provided with a glass. The support structure of the movement is formed by two plates and intermediate bridge members which are connected together by pillars. The gears, the hands spindles and the rotor of the motor are mounted rotatably in bearings which are fixed with respect to the different bridge members or plates. The printed circuit is also fixed on one of the plates, with a housing for the cell also being provided in the movement.

In order to reduce the overall thickness of the watch, it has already been proposed that the support structure of the movement can be omitted, and the movable components and the fixed components can be mounted directly on the bottom of the casing and possibly on the inside surface of the dial. In that case, there is no longer any movement, in the strict sense. This construction which is disclosed in French patent application No. 79 21 862 makes it possible very substantially to reduce the thickness of the watch, but producing such a watch is a delicate operation. Therefore, this construction cannot be applied to a watch of ordinary quality.

For the same purpose, it has also been proposed that the gears may be mounted in an overhung or cantilever position on a single plate. The motion members are mounted rotatably on ball-type micro-bearings which are themselves mounted on lug or stud portions forming an integral part of the plate. The wheels or pinions of the same gear are therefore necessarily disposed on the same side of the plate. A design of this kind is disclosed in Swiss Pat. No. 610178. This construction once again is fairly complex, both from the point of view of production and assembly of the watch. In addition, the Swill patent only concerns a mechanical watch, and therefore does not solve the problem of fitting the motor.

French Pat. No. 76 15 399 discloses a watch movement of conventional type, with two base plates, but in which the stator of the motor forms an intermediate bridge member in which one of the pivots of certain wheels is rotatably mounted, the other pivot being mounted in one of the base plates. This design therefore makes it possible to save the cost of an intermediate bridge member, but it does not substantially satisfy the overall structure of the watch and does not provide for any reduction in thickness.

SUMMARY OF THE INVENTION

In order to remedy these disadvantages, an object of the present invention is to provide an analog-display electronic watch of simplified structure which is easy to machine and assemble in mass-production, and which is of relatively small thickness, while permitting a wide spacing between the different components in order to improve the reliability of the watch.

According to the present invention, there is provided an analog-display electronic watch comprising a casing which is closed by a glass, and within the casing: spindles for hands; a motor comprising a rotor and a stator provided with a coil; a cell for supplying the motor; an electronic circuit for controlling the motor: gears coupling the motor to the spindles for the hands; a single plate apertured with at least one passage therethrough, in which a spindle for the gears is pivotally mounted, and further comprising means for pivotally mounting the spindles for the hands and means forming two bearings for the rotor; and means for fixing the periphery of the plate in the casing. In addition, and preferably, the other components such as the cell and the electronic circuit are fixed on the bottom of the casing.

It will be seen therefore that the movable mechanical members are in fact mounted on a single plate, which simplifies machining and assembly, but that the plate, in itself, forms the entire support structure of the movement, which considerably reduces the number of components. In addition, a reduction in thickness can be achieved by virtue of the printed circuit and the battery being fixed directly to the bottom of the casing.

In accordance with a preferred embodiment, the plate is formed by the stator of the rotor. This results in a further simplification in the structure of the watch and therefore a corresponding reduction in production cost.

BRIEF DESCRIPTION OF THE DRAWINGS

The invention will be described in more detail, by way of example, with reference to the accompanying drawings, in which.

DETAILED DESCRIPTION OF THE PREFERRED EMBODIMENT

Figure 1:
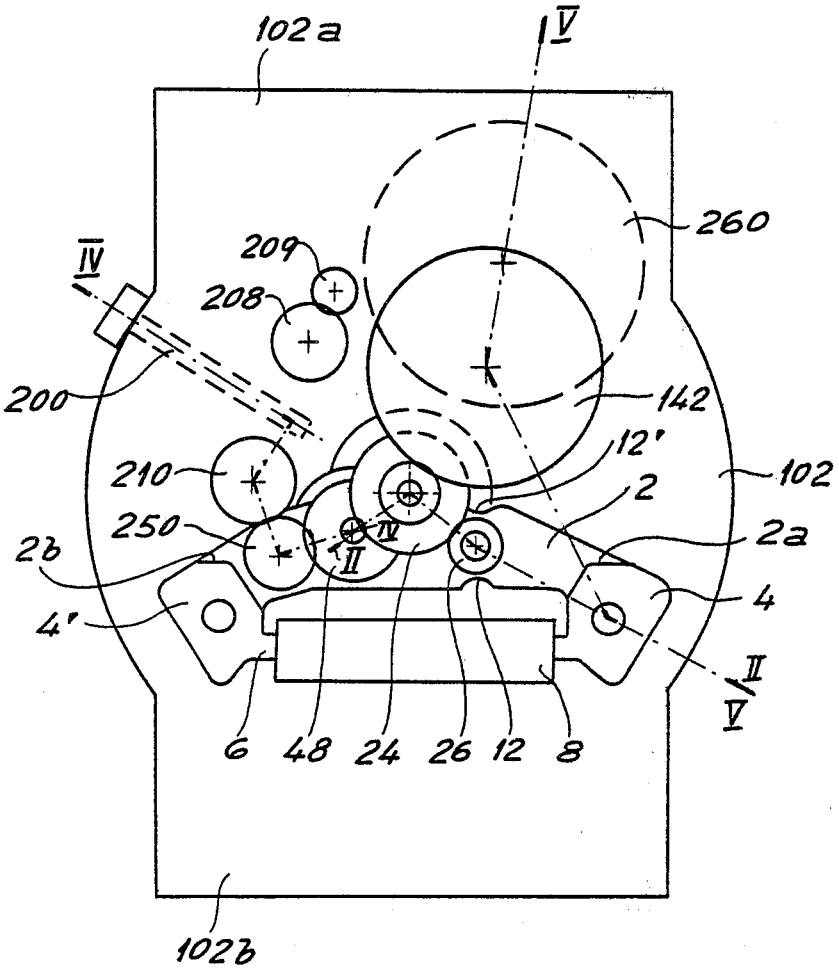
FIG. 1 shows a simplified plan view of the watch, the dial and the glass being removed in order more clearly to show the position of the various components.
Figure 2A:
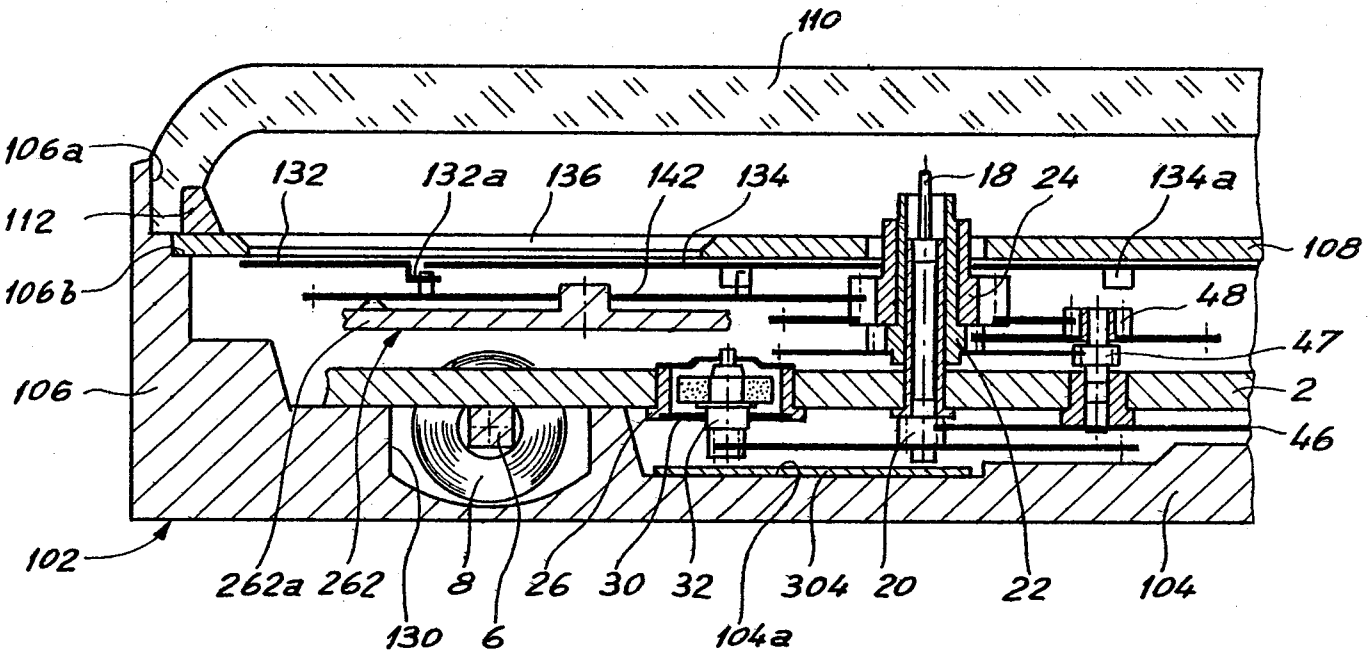
FIG. 2*a* is a sectional view taken along line II—II in FIG. 1.

FIGS. 1 and 2*a* show the general arrangement of the watch according to the invention, where the watch comprises hands for indicating hours, minutes and seconds, and also a ring member for displaying dates and a wheel for displaying days of the week.

The watch comprises a monocoque casing 102 which is preferably made of an injected-molded plastic material. In plan view, the casing 102 is of a general circular shape provided with two extension portions 102*a* and 102*b* which serve, inter alia, as lugs for fixing a strap or bracelet (not shown).

The casing 102 has a bottom 104 and a side wall 106 forming a peripheral casing portion and a mounting rim. The casing 102 is closed by a dial 108 and a glass 110. The glass 110 is fitted into a shoulder 106*a* on the side wall 106. The periphery of the dial 108 rests on a portion 106*b* of the side wall 106 and is held in place by the annular seal 112 which is interposed between the dial and the glass.

The internal space defined by the casing 102 and the dial 108 contains first of all a motor module. In the preferred embodiment of the invention, the motor module is formed from a motor of the Lavet type wherein the stator is of larger surface area than usual. The stator both acts in the normal manner as a magnetic circuit for guiding the magnetic flux generated by the coil, and also serves as a single plate for mounting the gears of the motor module. The stator is made for example of a ferro-nickel alloy which is commercially available under the Trade Mark "Vacoperm." It is for example 0.7 mm in thickness.

FIG. 1 shows that the stator 2 is in the general shape of a shallow V, the free ends 2*a* and 2*b* of which are connected to the lobes 4 and 4' of a coil core 6. The coil 8 is mounted on the core 6 in conventional manner. A substantially circular bore 10 in which the rotor of the motor is housed is formed in one of the limb portions of the V-shape formed by the stator 2. Notches 12 and 12' are formed in the stator, in line with the bore 10, in order with the bore 10 to define the isthmus portions separating the two poles of the stator. Thus, the stator occupies only a part of the surface area of the watch.

Figure 2B:
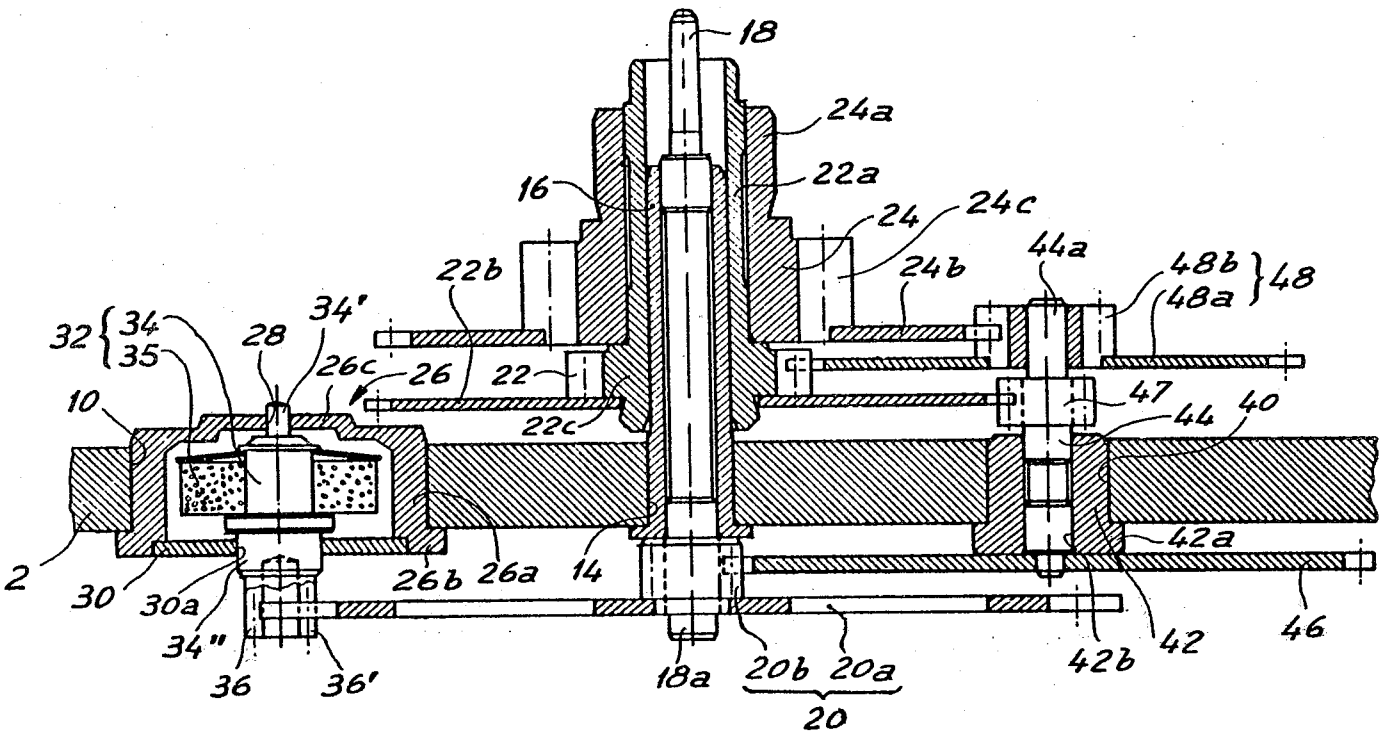
FIG. 2*b* is a view of details in FIG. 2*a*, showing the motor module.

In addition, the stator 2 is apertured with a certain number of bores for mounting the gears of the motor module, as can best be seen from FIGS. 2*a* and 2*b*.

A bore 14 for mounting the spindles for the hands is provided substantially at the apex of the V-shape formed by the stator. A guide tube 16 is driven into the bore 14 and projects beyond the upper surface of the stator. The seconds spindle 18 is engaged within the tube 16. A seconds gear 20 comprising a seconds wheel 20*a* and a seconds pinion 20*b* is fixed on the lower end 18*a* of the spindle 18. The minutes hand-carrying gear 22 is mounted on the outside surface of the tube 16 and conventionally comprises a pipe 22*a*, at the end of which the minutes hand is mounted, and a minutes wheel 22*b* and a minutes pinion 22*c*. This assembly is rotatable as a unit. The barrel wheel 24 is mounted on the outside surface of the pipe 22*a* of the member 22 and comprises on the one hand the pipe 24*a* on which the hours hand is mounted and, on the other hand, the hours wheel 24*b* and pinion 24*c*.

FIG. 2*b* also shows the manner in which the rotor of the motor is mounted in the bore 10 of the stator. A cup-shaped member 26 is force-fitted into the bore 10. The side wall 26*a* of the member 26 is therefore fixed with respect to the stator 10 and the member 26 is located axially by a flange 26*b*. The bottom portion 26*c* member 26 forms one bearing 28. A plate 30 which is force-fitted into the open end of the member 26 is provided with a bore 30*a* for forming a second bearing for the rotor of the motor. The rotor 32 conventionally comprises a shaft 34 on which the magnet 35 is mounted. One of the ends of the shaft 34 forms the pivot 34' which is engaged in the bearing 28. The other end of the shaft 34, which is thicker and which is denoted by reference numeral 34'', is mounted pivotally in the bore 30*a* and is extended by two lugs or spline portions 36 and 36'' which act as an output pinion.

It will thus be clearly seen that, when producing the motor module, the rotor 32 of the motor is already positioned with respect to the stator, by virtue of the presence of the members 26 and 30 which define the rotor bearings. It is therefore possible to eliminate the delicate operation of centering the rotor with respect to the stator, when assembling the movement.

As can be seen from FIG. 2*b*, the portions 36 and 36' which are fixed with respect to the shaft 34 of the rotor engage with the seconds wheel 20*a*. The connection between the seconds pinion 20*b* and the spindles for the hours and minutes hands is made by means of an assembly of gears which will now be described. The stator 2 comprises a further bore 40 in which a sleeve 42 provided with a flange 42*a* is force-fitted. The sleeve 42 comprises an axial bore 42*b* serving as a bearing for a spindle 44 which projects at both ends of the sleeve 42, that is to say, on both sides of the stator 2. Fixed on one of its ends is a wheel 46. Close to its other end is fixed a pinion 47. The wheel 46 engages with the pinion 20*b* while the pinion 47 engages with the minutes wheel 22*b*. The end 44*a* of the spindle 44 is trued to act as a pivot for a gear 48. The gear 48 conventionally comprises a wheel 48*a* and a pinion 48*b*. Thus, the spindle 44 has a double function, namely it fixes the wheel 46 and the pinion 47 to rotate together, and it acts as a pivot for the wheel 48.

In conventional manner, the pinion 47 is engaged with the minutes wheel 22*b*, thereby causing the member 22 to rotate. The wheel 48*a* engages with the pinion 22*c* of the member 22, while the pinion 48*b* engages with the hours wheel 24*b*.

It will be appreciated that the portions 36 and 36' which are provided at the end of the shaft of the rotor and which engage with the seconds wheel 20*a* could be replaced by a pinion of conventional kind. In addition, instead of the gear 48 being mounted on an extension of the axis member 44, it would be possible to provide an additional spindle which is fixed with respect to the stator 2. However, such a construction would suffer from the disadvantage of increasing the number of machining operations in the stator.

The advantages of the motor module are clearly apparent. The first advantage is that this assembly is a monoblock assembly and it can therefore be assembled in the factory. The remainder of the components of the watch such as the integrated circuit, the cell, the crystal, etc. can be fitted subsequently. In other words, virtually all the mechanical components are already assembled in the motor module.

Another advantage lies in the elimination of the bridge members, so as to use only a single plate which, in the preferred embodiment of the invention, is formed by the stator of the motor itself.

It will be appreciated that this method of producing the motor module would be applicable to a watch without a seconds hand. In that case, two constructions can be used. In the first, the minutes hand is mounted directly on the spindle 18. In that case, the gear ratio and the speed of rotation of the motor obviously has to be altered. The hours hand is then mounted on the gear forming the minutes hand-carrying member 22 in FIG. 2*b*. In that case, obviously the gear 48 is omitted and it is the gear formed by the wheel 46, the spindle 44 and the pinion 47, that acts between the minute and hour spindles.

Another construction involves completely omitting the member 18 and the seconds wheel 20*a*. In that case of course, the transmission wheel 46 must engage directly with the output of the rotor. In this case once again it is of course necessary for the speed of rotation of the motor and the gear ratio between the output pinion of the motor and the transmission wheel 46 to be altered.

These alternative forms have the same advantages as the first embodiment of the invention. In particular, in all cases, there is at least one gear which comprises an axis extending through the single plate which is preferably formed by the stator of the motor, and two wheels or pinions which are mounted on that axis and which are disposed on opposite sides of the single plate.

Figure 5:
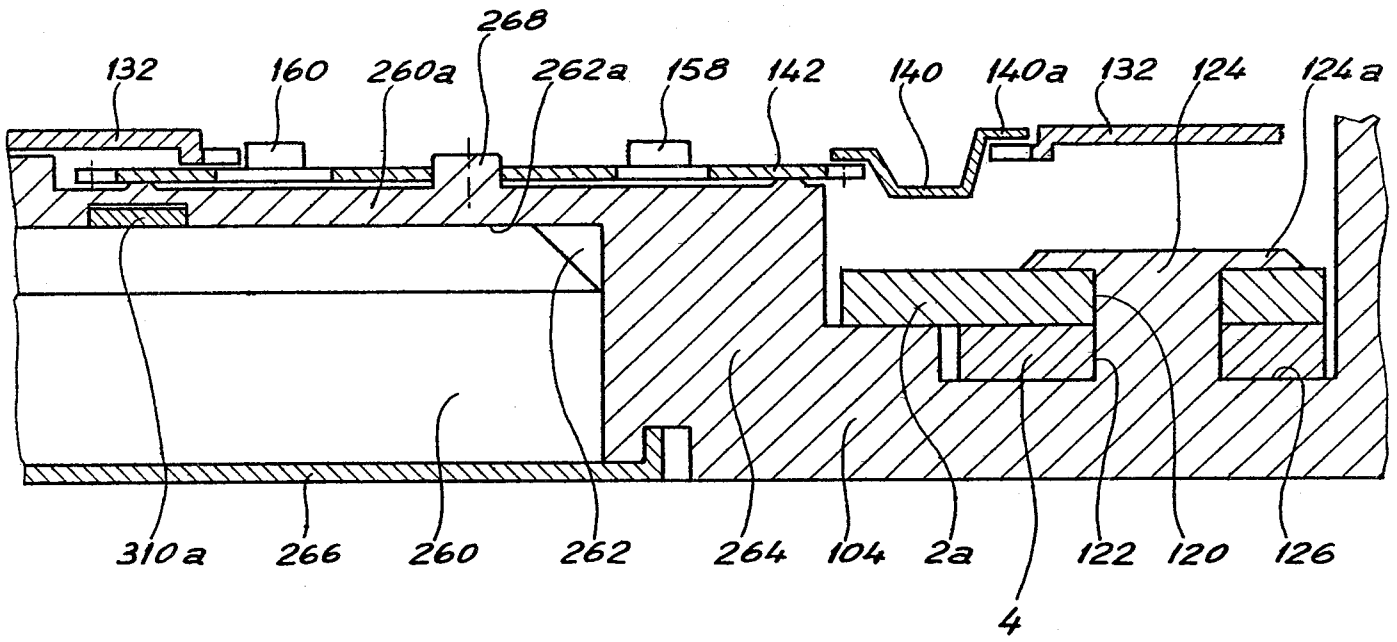
FIG. 5 is a sectional view taken along line V—V in FIG. 1, showing installation of the cell and a wheel for driving a date disc and a days wheel.

As can be best seen from FIG. 5, the stator 2 and the coil core 6 are fixed to the bottom portion 104 by heat-sealing. The ends 2*a* and 4 of the stator and the coil core are provided with respective bores 120 and 122. A lug or stud portion 124 forming an integral part of the bottom 104 passes through the bores 120 and 122. The head 124*a* of the portion 124 is subjected to hot deformation in order to produce on the one hand a connection between the stator 2 and the core 6, and on the other hand to fix the assembly in the casing, with the lobe 4 of the core 6 bearing on a support surface 126 of the bottom of the casing. The same kind of construction is used for connecting the end 2*b* of the stator and the lobe 4' of the coil core. More generally the fixing of the stator (or the single plate) is performed by engaging extension portions forming integral parts of the casing into fixing holes provided in the stator (or the single plate). The free ends of these portions are heated for producing a deformation of the said ends. In addition, FIG. 2*a* shows that the coil 8 is disposed in a housing recess 130 in the bottom 104 of the casing. This results in a saving in space in the dimension of the thickness of the casing.

In the preferred embodiment of the watch, the watch comprises a ring member 132 for displaying the date, and a disc 134 for indicating the days of the week. The markings carried by the ring member 132 and the disc 134 can be seen through an aperture 136 provided in the dial 108.

The ring member 132 is guided in its rotary movement by the peripheral portion 140*a* of a support plate 140 (FIGS. 4 and 5) while the days disc 134 is mounted idly on the barrel wheel 24 (FIG. 2*a*). The disc 134 and the ring member 132 are driven by a drive wheel 142 which engages with the pinion 24*c* of the barrel wheel 24. The drive wheel 142 will be described in greater detail hereinafter with reference to FIG. 6.

Figure 3:
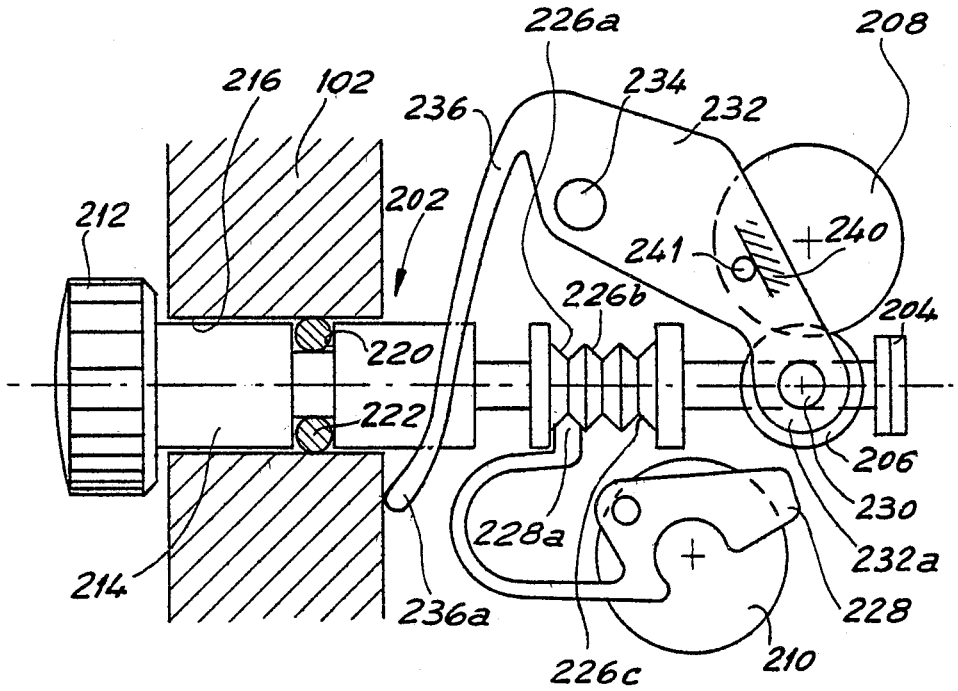
FIG. 3 is a plan view of part of the watch, showing the watch correction mechanism.
Figure 4:
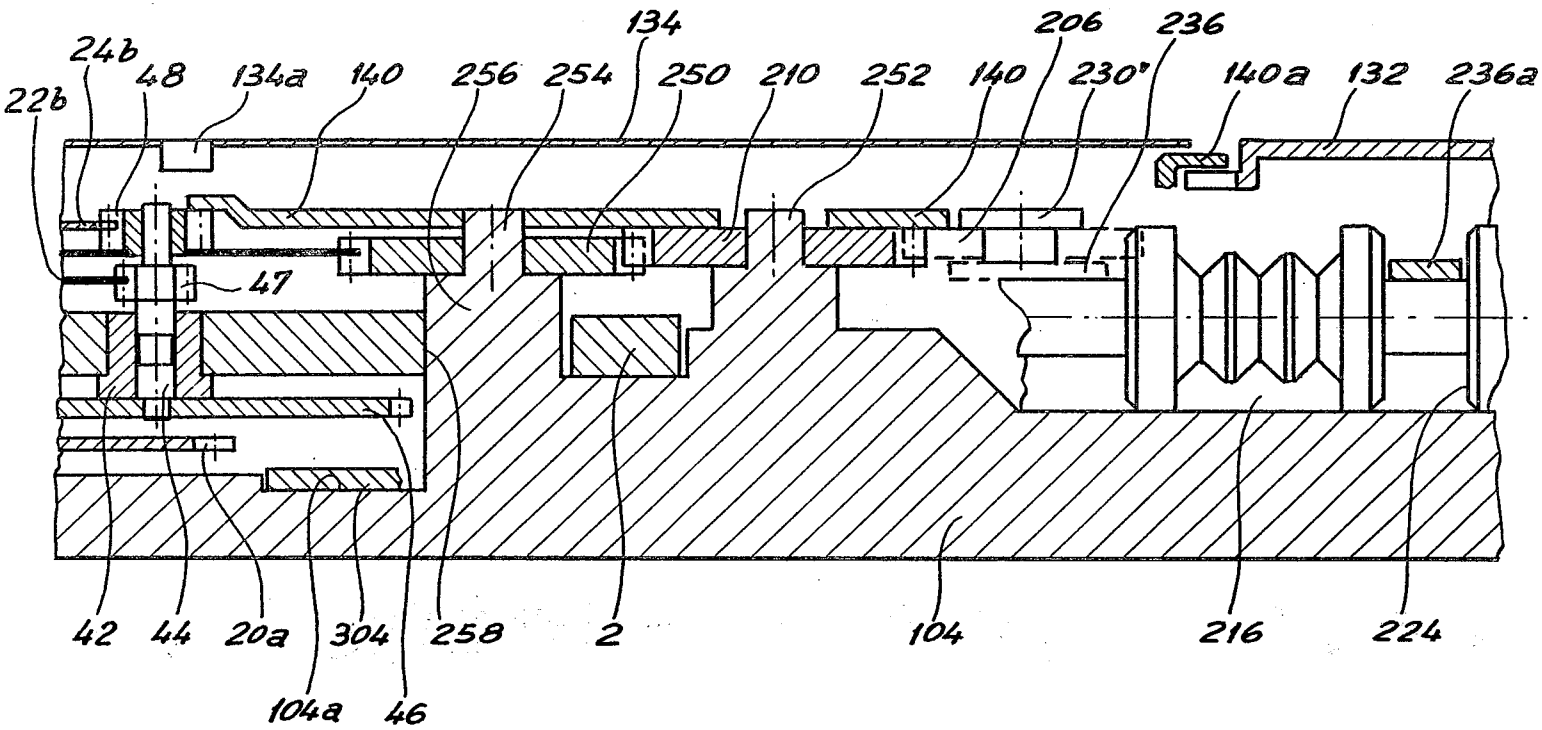
FIG. 4 is a sectional view taken along line IV—IV in FIG. 1, to shown installation of the correction mechanism of FIG. 3.

FIG. 1 diagrammatically indicates a setting mechanism 200 which is shown in greater detail in FIGS. 3 and 4. The mechanism 200 essentially comprises a stem 202, at the end of which is mounted a pinion 204 (castle wheel) which co-operates with an intermediate gear 206. The mechanism can engage with a first toothed wheel 208 which is the wheel for correcting the date, and with a second toothed wheel 210 for correcting the time. The intermediate gear 206 is mounted pivotally on a pin 230 which can be displaced, in a manner to be described hereinafter, but which remains parallel to the axes of the wheels 8 and 10.

The stem 202 firstly comprises a button 212 for the user of the watch to be able to move the stem axially and rotate the stem. The stem comprises a longitudinal guide portion 214 which co-operates with a guide groove 216 in the casing 102 of the watch, to guide the stem 202 in respect of axial and rotary movement. The guide portion 214 is provided with a groove 220 for a seal 222. The stem further comprises three grooves 226*a*, 226*b* and 226*c* which co-operate with an end 228*a* of a detent spring 228, thereby to define three axial positions of the stem 202. In FIG. 3, the end portion 228*a* of the spring 228 is engaged with the groove 226*a*, thereby to define the neutral position of the stem. Finally, at its end, the stem 202 comprises the toothed pinion 204. Preferably, the button 212 and the pinion 204 are made at the same time as the other machining operations on the stem 202.

The intermediate gear 206 is mounted rotatably on the pin 230 which is fixed to one end 232*a* of a lever 232 which will be referred to hereinafter as the rocker lever. The pin 230 is preferably in the form of the pin 230' shown in FIG. 4. The rocker lever 232 is mounted pivotally about an axis 234 which is fixed with respect to the support structure of the watch. The rocker lever 232 is extended beyond the axis 234 by an extension portion 236 forming a spring blade. The end 236*a* of the extension portion 236 abuts the wall 102 of the watch casing. In this way, the end 236*a* of the resilient blade is stationary in the direction of displacement of the stem 202.

Finally, the mechanism comprises a stop 240 which is fixed with respect to the support structure and which can co-operate with a lug or stud 241 which is fixed on the rocker lever 232. The stop is so positioned that, when the stem 202 is in a rest position, that is to say, in the position shown in FIG. 1, the gear 6 does not engage with the pinion 4, and the blade 236 is slightly stressed. It will be appreciated that this mechanical abutment can be formed by any suitable means.

When the stem 202 has been pushed completely in, which corresponds to the neutral position, the stem can be rotated without acting on the wheel 208 or 210. The stem 202 is held in that position by the end 228*a* of the spring being engaged in the groove 226*a*. The spring blade 236 is so defined that, with the stem 202 in that position, the lug 241 of the rocker lever is held against the abutment 240 by the tensioning of the spring 236. The gear 206 is engaged with the first wheel 208 but not with the pinion 204 of the stem 202. Rotary movement of the stem therefore does not produce any effect.

When the user wishes to correct the date, he moves the stem 202 into a position in which it is half way out. The gear 206 does not move and therefore remains engaged with the wheel 208. The travel of the stem is such that the pinion 204 comes into engagement with the gear 206. The lever 230 does not move and is held in position by the blade 236 which urges the lug 241 against the stop 240. As regards the stem, it is held in that position by the end 228*a* of the spring 228 engaging into the groove 226*b*. If the user then rotates the stem, the rotary movement of the pinion 204 causes rotary movement of the gear 206 which in turn rotates the wheel 208, thereby permitting correction of the date, since the wheel 208 engages with the date ring member 132 by way of the gear 209.

The stem, in the position in which it is pulled completely out, permits the wheel 210 to be driven. Then the stem moves from the first active position to that second active position, The translation movement of the stem 202 causes pivotal movement of the rocker lever 232 about its axis 234 by the action of the pinion 204 on the gear 206 or by the pinion 204 acting directly on the rocker lever 230. When that movement is produced, the gear 206 comes into engagement with the wheel 210, having come clear of the wheel 208. The stem is held in that position by the end 228*a* of the spring, which engages in the groove 226*c*. In that position, the user, by rotating the stem 202, causes the time correction wheel 210 to rotate. The length of the pivotal movement of the rocker lever is such that, in both the second and third positions of the stem, the gear 206 is engaged with the pinion 204.

As can be seen from FIGS. 1 and 4, the wheel 210 engages with a wheel 250 which in turn engages with the gear 48. When the stem is in the position of being pulled completely out, the stem 202 can therefore be used to alter the hours and minutes. Preferably, the wheels 210 and 250 are mounted rotatably on spindles formed by lugs or studs 252 and 254 which are integral parts of the bottom 104 of the casing. The base portion 256 of the lug 254 passes through a bore 258 in the stator 2. In this way, it also helps to fix the stator 2 in position. In addition, the wheels 210 and 250 are held in place by the support plate 140.

Referring now to FIG. 5, it will be seen that the cell 260 for supplying power for the watch is housed in a chamber 262 provided in a thick portion 264 of the watch casing, and that portion projects into the extension portion 102*a*. The chamber 262 is closed by a cell-retaining cover 266. The cell is held between the upper wall surface 262*a* of the chamber 262 and the cover 266. Therefore, the operation of changing a cell does not involve any dismantling operation. FIG. 5 also shows that the drive wheel 142 is mounted rotatably about a lug or stud 268 which is an integral part of the wall 262*a*. Finally, FIG. 5 shows that the upper part of the cell 260 is disposed at a level which is above the level of the stator 2. This therefore results in a substantial reduction in the thickness of the casing. Moreover, the chamber 262 provides a certain degree of confinement for the cell, which is interrupted only by the passage for the electrical connecting strap members to pass through the structure.

Figure 6:
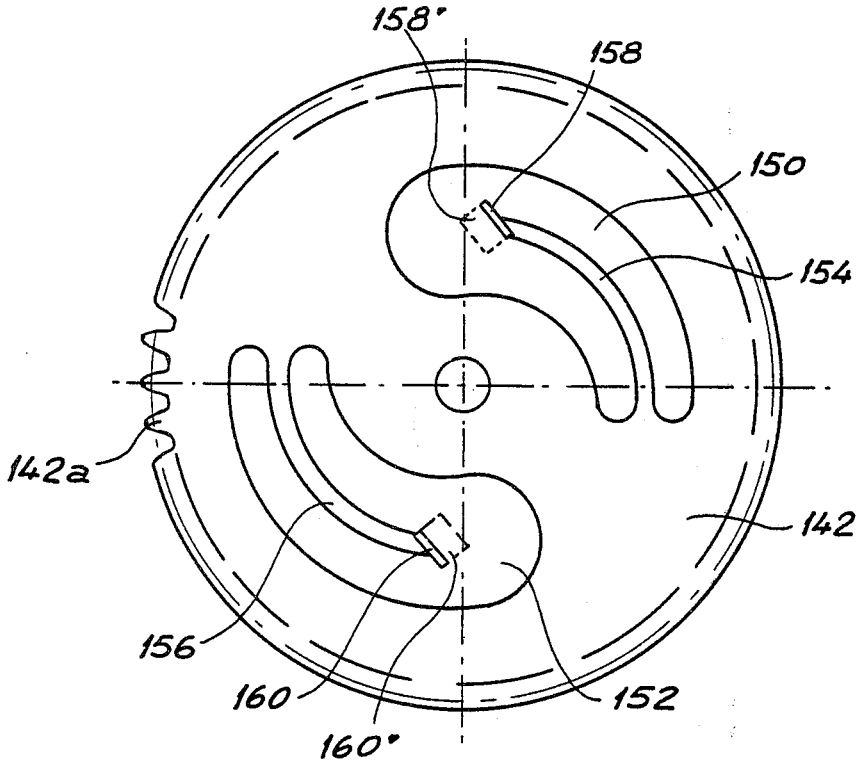
FIG. 6 is a plan view of a preferred embodiment of the drive wheel.

FIG. 6 is a plan view of a preferred embodiment of the wheel 142 for driving the date display, and is made for example of cupro-beryllium. On its periphery, it has teeth 142*a* engaging with the pinion 24*c* of the barrel wheel. The wheel comprises two openings 150 and 152 which define two curved arm portions 154 and 156 which are integral parts of the wheel. Each arm portion ends in an enlarged lug 158 and 160 respectively, at its end. The enlarged lugs 158 and 160 are bent in such a way as to extend perpendicular to the plane of the wheel. The bend is diagrammatically illustrated by the areas shown by broken lines at 158' and 160'. The lugs 158 and 160 can be engaged on the one hand with teeth 132 provided on the inward edge of the ring member 132 and on the other hand with teeth 134*a* formed on the bottom surface of the disc 134. Those teeth are produced for example by being cut from and bent from the disc 134.

The resilient arm portions 156 and 154 permit the lugs 158 and 160 to be disengaged from the teeth 132*a* of the ring member 132 when the user of the watch alters the date by means of the stem 202. This disengagement action is produced by resilient deformation of the arm portion 156 or 154, in the direction of curvature thereof, for a given direction of rotation.

This mode of producing the drive wheel 142 is particularly attractive as it only requires the sheet metal forming the wheel to be cut and bent. However, the resulting resiliency of the arm portions is sufficient to ensure proper operation of the mechanism.

Figure 7:
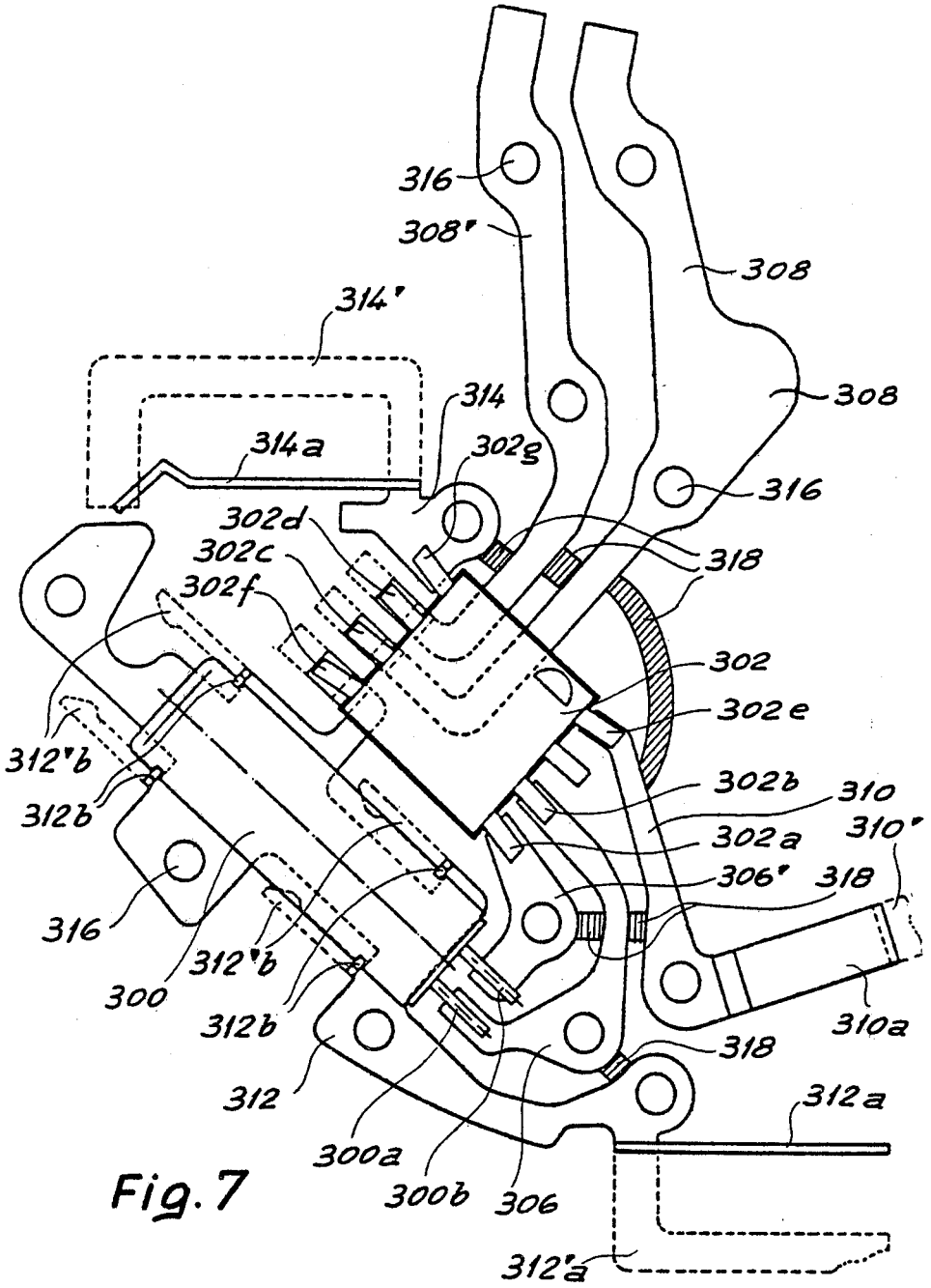
FIG. 7 is a plan view of a preferred embodiment of the printed circuit of the watch.

Hitherto, the description has been concerned more particularly with the mechanical components of the watch. Reference will now be made to FIG. 7 to describe the electronic circuit for controlling the motor of the watch. As is well known, the electronic circuit essentially comprises a crystal resonator, forming the time base, which is encapsulated in a cylindrical casing 300 and which is provided with terminals 300*a* and 300*b*, an integrated circuit 302, which processes the pulses delivered by the resonator 300, and conducting tracks connecting the components together and also connecting the components to the cell 260 and the coil 8 of the motor. In the preferred embodiment of the invention, the conducting tracks are pre-cut or pre-etched, and then fixed to the upper surface 104*a* of the bottom of the casing, which is of insulating material and acts as the insulating substrate for the printed circuit. In FIGS. 2*a* and 4, reference numeral 304 indicates the conducting tracks.

More particularly, the conducting tracks comprise tracks 306 and 306' which connect the terminals 300*a* and 300*b* of the resonator to the terminals 302*a* and 302*b* of the integrated circuit, tracks 308 and 308' connecting the terminals 302*c* and 302*d* of the integrated circuit to the coil of the motor, track 310 which connects the negative terminal of the cell 260 to the terminal 302*e* of the integrated circuit, track 312 which connects the positive terminal of the cell 260 to the terminal 302*f* of the printed circuit and finally, track 314 connecting the terminal 302*g* of the integrated circuit to a zero resetting input. In actual fact, the tracks are not all coplanar. The end portion 310*a* of the track 310 is bent, the part shown in broken lines at 310' representing the end of the track before it was bent. As can be seen from FIG. 5, the end portion 310*a* is gripped between the upper electrode 260*a* of the cell 260 and the upper wall surface 262*a*. Likewise, the end portions of the tracks 308 and 308' are bent for them to be soldered to the terminals 302*c* and 302*d* of the integrated circuit, the parts shown in broken lines representing those end portions before being bent. In addition, the track 314 has a bent curved end portion 314*a* to form a flexible electrical contact blade. The region shown in broken lines at 314' represents the end portion of the track before it is bent.

The track 312 is more complex in shape. The end portion 312*a* thereof is bent to form the positive contact to the side of the battery 260. The part shown in broken lines at 312'*a* represents that end portion before being bent. The track 312 further comprises four resilient tongue portions 312*b* which, once they have been bent, serve to fix the casing of the resonator 300. The parts shown in broken lines at 312'*b* show the tongue portions 312*b* before they are bent. Finally, each track has at least one hole denoted by the general reference numeral 316.

The preferred mode of design and assembly of the electronic circuit to the bottom 104 of the casing will now be described. The whole of the tracks 308 to 314 are first made from a copper plate, for example 0.15 mm in thickness, with the further provision of thin bridge portions indicated at 318, for mechanically interconnecting the various tracks, some of the bridge portions 318 being shown hatched in FIG. 7. The above-mentioned bending operations are carried out on the assembly of tracks which constitute a single component. The terminals 302*a* to 302*g* of the integrated circuit are then secured by soldering or bonding to the ends of the corresponding tracks, the resonator 300 is put in place in its fixing lugs 312*b*, and the terminals 300*a* and 300*b* of the resonator are fixed by soldering or bonding to the ends of the appropriate tracks. After they have been fixed together, those two components, by themselves, form the mechanical connection between the conducting tracks. It is then possible for the bridge portions 318 to be cut away, while still having a mechanical connection between the tracks. After that operation, the arrangement is placed on the upper surface 104*a* of the bottom of the casing, in such a way that the lugs or studs forming an integral part of the bottom of the casing, of heat-fusible plastics material, engage into the holes 316 provided in the conducting tracks. The heads of the lug portions are heated and deformed to fix the assembly of the electronic circuit to the bottom of the casing, by heat-sealing.

It will first been seen that this embodiment of the printed circuit makes it possible to save the expense of the conventional insulating substrate. Then, the mode of manufacture of the printed circuit assembly is highly suitable for mass production, taking into account the nature of the steps involved and the fact that the conducting track elements are permanently mechanically connected together. In addition, this mode of operation is particularly suitable for the case where the insulating substrate is formed by the bottom of the casing, since there is no longer any operation that has to be carried out on the electronic circuit after it has been fixed in place; such operations would be particularly delicate ones, in this particular situation. Finally, this mode of production gives a modular assembly which already includes all the electrical connecting components, including the battery connecting strap or arm members.

It will be seen from the whole of the foregoing description that the particular arrangement of the watch permits the components thereof to be spaced and isolated from each other to a substantial degree, even though the overall thickness (including the glass) of the watch is still very reasonable, for example 8 mm, with the thickness between the outside surface of the bottom of the casing and the inside surface of the dial being of the order of 4.5 mm.

In addition, because in actual fact the watch has a motor module and an electronic module, each in the form of a unit, the operation of final assembly of the watch is greatly simplified and no longer involves delicate stages.

In addition, the omission of costly components such as the bridge members for the movement mechanism and the bearings, or components which are difficult to machine, such as a sliding pinion, in conjunction with the simplification in the assembly operation, make it possible substantially to reduce the cost of manufacture, without detrimentally affecting the reliability and the accuracy of the watch.

Finally, it is clear that it would not be a departure from the present invention to produce a watch of the above-described type, which comprised neither a display in respect of the date nor a display in respect of the days of the week. It is also clear that, if the above-described electronic circuit were replaced by a conventional printed circuit with an insulating substrate, the substrate being for example secured by adhesive or fixed to the bottom of the casing, that also would not constitute a departure from the present invention.

What is claimed is:

1. An analog-display electronic watch comprising a casing, a glass closing said casing, and, within said casing:

hands and hand spindles for carrying said hands;

a motor comprising a rotor and a stator, said stator being provided with passages extending therethrough;

an electronic circuit for controlling said motor;

a power cell for supplying said motor and said circuit;

gear means for coupling said rotor with said hand spindles;

means, located within said passages in said stator, for pivotally mounting said rotor, said hand spindles and said gear means in said stator, said means being the only mounting means for said rotor, said hand spindles and said gear means; and means for mounting said stator in said casing.

2. An electronic watch according to claim 1, wherein said casing is of a monocoque construction and comprises a bottom and a side wall, said cell and said electronic circuit being fixed on said bottom of said casing.

3. An electronic watch according to claim 2, wherein said electronic circuit comprises a plurality of conducting tracks, a resonator and an integrated circuit, said casing being made of an insulating material, said conducting tracks being directly fixed on said bottom of said casing and said integrated circuit and resonator being connected with said conducting tracks.

4. An electronic watch according to claim 3, wherein said casing is made of a material which is further heat-fusible, said conducting tracks being fixed on said bottom of said casing by heat sealing.

5. An electronic watch according to claim 4, wherein at least one end of a conducting track is bent to form a connecting strap member for said cell.

6. An electronic watch according to claim 5, wherein said bottom of said casing comprises a thicker region wherein there is provided a housing provided with an opening outwardly of the watch, and an upper wall, the opening being closed by a closure means, said cell being placed in said housing and gripped between said upper wall of said housing and said closure means.

7. A watch according to claim 6, wherein a portion of said cell is disposed at a level higher than that of said stator.

8. An electronic watch according to claim 12, further comprising a dial, a date display ring member, a disc for displaying the days of the week, and a wheel for driving the ring member and the disc, said wheel comprising a peripheral tooth arrangement and two openings which do not open into the tooth arrangement and which each define a resilient arm with a free end forming an integral portion of said wheel and comprising at said free end a portion which is bent into a position substantially perpendicular to the plane of the wheel for engaging with said ring member and said disc.

9. A watch according to claim 1, wherein said casing is made of a heat fusible insulating material, said mounting means comprising extension portions forming integral parts of said casing, said extension portions passing through fixing-holes provided in said stator, the end of said extension portions being hot deformed for fixing said stator on said casing.

* * * * *